US009873556B1

(12) United States Patent
Dancer et al.

(10) Patent No.: US 9,873,556 B1
(45) Date of Patent: Jan. 23, 2018

(54) PRODUCT PACKAGE AND A METHOD FOR PACKAGING A PRODUCT

(71) Applicant: Kenney Manufacturing Company, Warwick, RI (US)

(72) Inventors: Jay Colin Dancer, Attleboro, MA (US); Stephen Britcliffe, New Bedford, MA (US)

(73) Assignee: Kenney Manufacturing Company, Warwick, RI (US)

( * ) Notice: Subject to any disclaimer, the term of this patent is extended or adjusted under 35 U.S.C. 154(b) by 492 days.

(21) Appl. No.: 13/966,701

(22) Filed: Aug. 14, 2013

Related U.S. Application Data

(60) Provisional application No. 61/683,150, filed on Aug. 14, 2012.

(51) Int. Cl.

| | |
|---|---|
| ***B65D 71/00*** | (2006.01) |
| ***B65D 85/00*** | (2006.01) |
| *B65D 5/02* | (2006.01) |
| *B65D 5/42* | (2006.01) |

(52) U.S. Cl.
CPC ..... *B65D 85/54* (2013.01); *B65D 5/0254* (2013.01); *B65D 5/4204* (2013.01)

(58) Field of Classification Search
CPC ..... B65D 5/0254; B65D 5/4204
USPC ..... 206/326, 461, 581, 775–782, 806; 229/120.06, 121; 312/117, 249.1
See application file for complete search history.

(56) References Cited

U.S. PATENT DOCUMENTS

| | | | |
|---|---|---|---|
| 312,421 | A | 2/1885 | Bauer |
| 364,558 | A | 6/1887 | Wamsley et al. |
| 386,079 | A | 7/1888 | McDonald |
| 393,800 | A | 12/1888 | Uridge |
| 396,187 | A | 1/1889 | Worthington |
| 415,960 | A | 11/1889 | Coe |
| 436,313 | A | 9/1890 | Norcross |
| 494,061 | A | 3/1893 | Day |
| 610,291 | A | 9/1898 | Thorens |
| 685,649 | A | 10/1901 | Schrader |
| 1,108,006 | A | 8/1914 | Rey |
| 1,112,752 | A | 10/1914 | Avellanal |

(Continued)

FOREIGN PATENT DOCUMENTS

| | | | |
|---|---|---|---|
| FR | 2036632 | A5 | 12/1970 |
| FR | 2617128 | A1 | 12/1988 |
| GB | 465739 | A | 5/1937 |

*Primary Examiner* — Luan K Bui
(74) *Attorney, Agent, or Firm* — Adler Pollock & Sheehan P.C.; Daniel J. Holmander

(57) ABSTRACT

A product package for displaying a bath product is provided and includes a package outer structure and a package inner structure, wherein the package outer structure is configured to define an inner cavity for containing product and wherein the package outer structure includes cutout portions to define a first display window and a second display window for displaying two views of the bath product. The package inner structure is configured to be contained within the inner cavity such that when contained within the inner cavity the package inner structure supports a first bath product such that at least a portion of the first bath product is displayed in the first display window, and wherein the package outer structure supports a second bath product such that at least a portion of the second bath product is displayed in the second display window.

15 Claims, 21 Drawing Sheets

(56) References Cited

U.S. PATENT DOCUMENTS 1,139,134 A 5/1915 Miller
1,146,128 A 7/1915 Hogg et al.
1,167,847 A 1/1916 Schoettle
1,518,219 A 12/1924 Peter
1,604,750 A 10/1926 Grubman
1,670,498 A 5/1928 Einson
1,838,687 A 12/1931 Lawson, Sr. et al.
1,930,235 A 10/1933 Fox
1,932,705 A 10/1933 Menten
2,024,809 A 12/1935 Schell
2,128,197 A 8/1938 Weil
2,162,089 A * 6/1939 Kagen ..... B65D 5/0254 206/777
2,339,555 A 1/1944 Glass
2,353,376 A 7/1944 Vatter
2,395,179 A 2/1946 Genjack
2,498,757 A 2/1950 High
2,523,415 A 9/1950 Bowers
2,582,476 A 1/1952 Buttery
2,643,811 A 6/1953 Bolding
2,645,337 A 7/1953 Stenger
2,649,807 A 8/1953 Ritter
2,697,297 A 12/1954 Newberg
2,711,819 A 6/1955 Vander Lugt, Jr.
2,744,622 A * 5/1956 Sparks ..... B65D 5/4204 206/521.2
2,807,404 A 9/1957 Cote
2,810,987 A 10/1957 Denbow
2,827,219 A 3/1958 Sparks
2,868,361 A 1/1959 Zilem et al.
2,888,185 A 5/1959 Porter
2,913,101 A * 11/1959 Daily ..... B65D 5/4204 206/216
2,921,673 A 1/1960 Ryan
3,047,204 A 7/1962 Wolowicz
3,093,290 A 6/1963 Banks et al.
3,132,653 A 5/1964 Gazdik
3,135,453 A 6/1964 Struble
3,168,952 A 2/1965 Palmer
3,184,142 A 5/1965 Rosenburg, Jr.
3,185,048 A 5/1965 Struble
3,233,726 A 2/1966 Gero
3,235,163 A 2/1966 Hennessey
3,347,356 A 10/1967 Kossnar
3,413,756 A 12/1968 Gardel et al.
3,429,428 A 2/1969 Fowler
3,446,414 A 5/1969 Omori
3,475,525 A 10/1969 Peters
3,476,933 A 11/1969 Mendelsohn
3,514,899 A 6/1970 Bonanno et al.
3,533,503 A 10/1970 Wood et al.
3,587,837 A * 6/1971 Smith ..... B65D 5/4204 206/387.11
3,780,931 A 12/1973 Hanson
3,796,005 A 3/1974 Chang et al.
3,804,321 A 4/1974 Forbes, Jr.
3,811,565 A 5/1974 Tancredi
3,845,898 A 11/1974 Hackenberg
3,847,276 A 11/1974 Lehner et al.
3,894,550 A 7/1975 Eaton
3,977,292 A 8/1976 Favilli et al.
4,094,404 A 6/1978 Miller et al.
4,098,397 A 7/1978 Mann, Jr. et al.
4,105,154 A 8/1978 Meyers et al.
4,109,786 A 8/1978 Roccaforte et al.
4,114,796 A 9/1978 Voges
4,121,416 A 10/1978 Niemczyk
4,121,600 A 10/1978 Riddick et al.
4,125,185 A 11/1978 Bliss
4,129,210 A 12/1978 Brown et al.
4,159,765 A 7/1979 Roccaforte
4,175,353 A 11/1979 Pickett
4,180,165 A 12/1979 Kuchenbecker
4,185,739 A 1/1980 Wilford
4,221,454 A 9/1980 Wong
4,230,258 A 10/1980 Lane
4,237,647 A 12/1980 Shaw
4,249,338 A 2/1981 Wexler
4,260,059 A 4/1981 Roccaforte
4,261,466 A 4/1981 Wilford
4,300,683 A 11/1981 Roccaforte
4,319,681 A 3/1982 Gestetner
4,342,417 A 8/1982 Forbes, Jr.
4,353,461 A 10/1982 Liang
4,462,135 A 7/1984 Sanford
4,487,311 A 12/1984 Lavery
4,501,359 A 2/1985 Yoshizawa
4,696,653 A 9/1987 McKeefery
4,702,374 A 10/1987 Kelner
4,739,353 A 4/1988 Heuer et al.
4,740,187 A 4/1988 Rasmussen et al.
4,767,374 A 8/1988 Yang
4,804,984 A 2/1989 Heuer et al.
4,820,236 A 4/1989 Berliner et al.
4,848,577 A 7/1989 Hoffman et al.
4,867,726 A 9/1989 Fujimaki
4,925,025 A 5/1990 Anten et al.
5,005,701 A 4/1991 Dutcher
5,033,617 A 7/1991 Hartwein et al.
5,067,609 A * 11/1991 Stout ..... B65D 5/4204 206/216
D326,814 S 6/1992 Arai
5,144,744 A 9/1992 Campagnoli
5,172,806 A * 12/1992 Mickelberg ..... B65D 5/4204 206/459.5
5,215,193 A * 6/1993 Dennis ..... A47K 5/18 132/309
5,242,107 A 9/1993 De Nola
5,284,291 A 2/1994 Sellors
5,337,099 A 8/1994 Tasaka et al.
5,358,101 A 10/1994 Lombardi
5,358,116 A 10/1994 Brintazzoli
5,409,105 A 4/1995 Appelbaum et al.
5,411,138 A 5/1995 Klawiter
5,465,834 A 11/1995 Sieber et al.
5,602,612 A 2/1997 Angeli et al.
5,607,058 A * 3/1997 Huesman ..... B65D 5/4204 206/581
5,673,796 A 10/1997 Tulloch
5,683,284 A 11/1997 Christen
5,711,424 A 1/1998 Kiesow
5,738,211 A 4/1998 Ichino et al.
5,755,327 A 5/1998 Saltzman et al.
5,813,523 A * 9/1998 Gnadt ..... B65D 5/4204 206/590
5,823,339 A 10/1998 Dunham et al.
5,919,074 A 7/1999 Honda
6,011,489 A 1/2000 Ki Kwan et al.
6,089,369 A * 7/2000 Markey ..... B65D 5/4204 206/349
6,234,308 B1 * 5/2001 Saffron ..... B65D 5/4204 206/316.2
6,319,087 B1 11/2001 Ferrigno
6,330,494 B1 12/2001 Yamamoto
6,381,515 B1 4/2002 Inoue et al.
6,421,585 B1 7/2002 Takamura
6,520,828 B2 2/2003 Ferrigno
6,567,724 B2 5/2003 Yamamoto
6,591,165 B2 7/2003 Takamura
6,705,919 B2 3/2004 Curran et al.
6,727,826 B1 4/2004 Ki Kwan et al.
7,240,791 B2 7/2007 Alpert et al.
7,475,775 B2 1/2009 Fattori
7,641,052 B2 1/2010 Calendrille, Jr.
7,954,641 B2 6/2011 Calendrille, Jr. et al.
8,191,713 B2 6/2012 Calendrille, Jr.
8,210,896 B2 7/2012 Wittenberg
8,371,896 B2 2/2013 Baytman et al.
8,408,393 B2 4/2013 Buynak et al.
D685,649 S 7/2013 Banuelos
2007/0241027 A1 * 10/2007 Yang ..... B65D 5/4204 206/580

* cited by examiner

PRODUCT PACKAGE AND A METHOD FOR PACKAGING A PRODUCT

RELATED APPLICATION

This application claims priority to and benefit of the filing date of U.S. Provisional Patent Application Ser. No. 61/683,150, filed Aug. 14, 2012, the contents of which are incorporated by reference herein in its entirety.

FIELD OF THE INVENTION

The present invention relates generally to a product packaging and more specifically to an aesthetically pleasing product package, for a bath product such as a shower hook, where the packaging displays multiple views of the bath product.

BACKGROUND OF THE INVENTION

Product packaging is an integral part of any product and has many functions that are important to the life cycle of the product—from manufacturing to sale/use by the consumer. One such important function involves protecting the product from damage, contamination and tampering. Another important function is to contain the product in a defined package to keep the product elements and literature together in one minimized container. Moreover, for some products the packaging may be essential in protecting the product during shipping and storage, where packages that are easily stackable and/or water-proof allow for easier and cheaper transport and storage. Additionally, product packaging is now used extensively for sales and promotion of the product. Thus manufacturers are relying more and more on the packaging to attract attention while drawing in and making a favorable impression to potential consumers. As such, the way a product is packaged can have a huge impact on the sale of the product.

In fact, research has shown that most consumers are willing to pay more for the appearance and prestige of a product that has a better or more elegant packaging (i.e. 'high end' product) than for a product that has a more generic or plain packaging (i.e. low end' product). Accordingly, a product package should be robust enough to protect the product and display the brand, yet attractive enough to capture the interest of the potential buyer. Unfortunately, however most product packaging focuses on either the transportation of the product, the storage of the product or communication of product information about the product. As such, these product packages are less aesthetically pleasing, generically shaped and/or so 'busy' with information that the potential buyer has difficulty determining what they are actually buying. This is undesirable because it has a direct negative effect on the sales of the product.

SUMMARY OF THE INVENTION

A product package for displaying a bath product is provided and includes a package outer structure and a package inner structure, wherein the package outer structure is configured to define an inner cavity for containing product and wherein the package outer structure includes cutout portions to define a first display window and a second display window for displaying two views of the bath product. The package inner structure is configured to be contained within the inner cavity such that when contained within the inner cavity, the package inner structure is configured to support a first bath product such that at least a portion of the first bath product is displayed in the first display window. The package outer structure is configured to support a second bath product such that at least a portion of the second bath product is displayed in the second display window. It is contemplated that the bath product may be a shower hook, but is not limited to a shower hook and may be any bath or home product. Moreover, the product package may further include a translucent outer package including a hanger tab having a hanger opening for engaging with a product hanger so that the package can be associated with a hanging display.

A product package for displaying a bath product is provided and includes a package outer structure and a package inner structure, wherein the package outer structure defines an inner cavity for containing the package inner structure and a plurality of bath products and wherein the package outer structure includes a first cutout portion which defines a first display window and a second cutout portion which defines a second display window, wherein the first and second display windows are viewable from the front and at least one side of the product package, and wherein the package inner structure is configured to be contained within a portion of the inner cavity such that when contained within the inner cavity, the package inner structure supports a first bath product of the plurality of bath products such that at least a portion of the first bath product is displayed in the first display window, and the package outer structure supports a second bath product of the plurality of bath products such that at least a portion of the second bath product is displayed in the second display window.

A product package for displaying a product is provided and includes a package outer structure which defines an inner cavity for containing a plurality of products, wherein the package outer structure includes a first cutout portion that defines a first display window and a second cutout portion that defines a second display window, wherein the first display window and second display window are viewable from the front and at one side of the product package, wherein the product package includes a support surface for supporting a first product of the plurality of products such that the first product is displayed in the first display window; and wherein the package outer structure is configured to support a second product of the plurality of products such that the second product is displayed in the second display window.

A method for displaying a product, wherein the product package includes a first display window and a second display window is provided, wherein the method includes assembling the product package having a package outer structure and a package inner structure, wherein the package outer structure defines an inner cavity for containing the package inner structure and at least one product and includes a first cutout portion which defines a first display window and a second cutout portion which defines a second display window, wherein the first display window and second display window is viewable from the front and at least one side of the product package. The method further includes associating a first product of the at least one product with the package inner structure such that the first product is displayed in the first display window; and associating a second product of the at least one product with the package outer structure such that the second product is displayed in the second display window.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike.

DETAILED DESCRIPTION OF THE INVENTION

Figure 1:
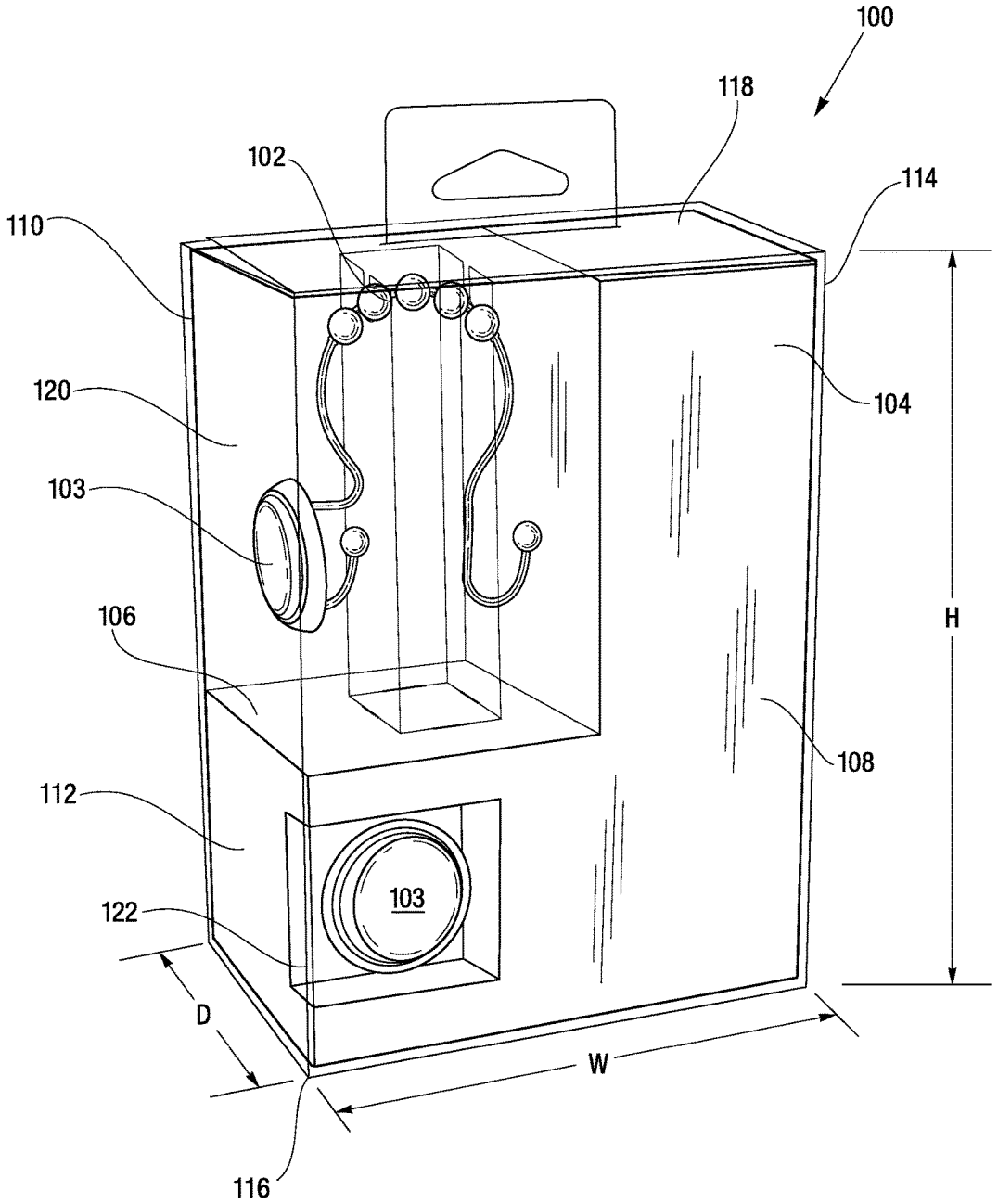
FIG. 1 is a front side perspective view of a package for a bath product, in accordance with one embodiment of the invention.
Figure 2:
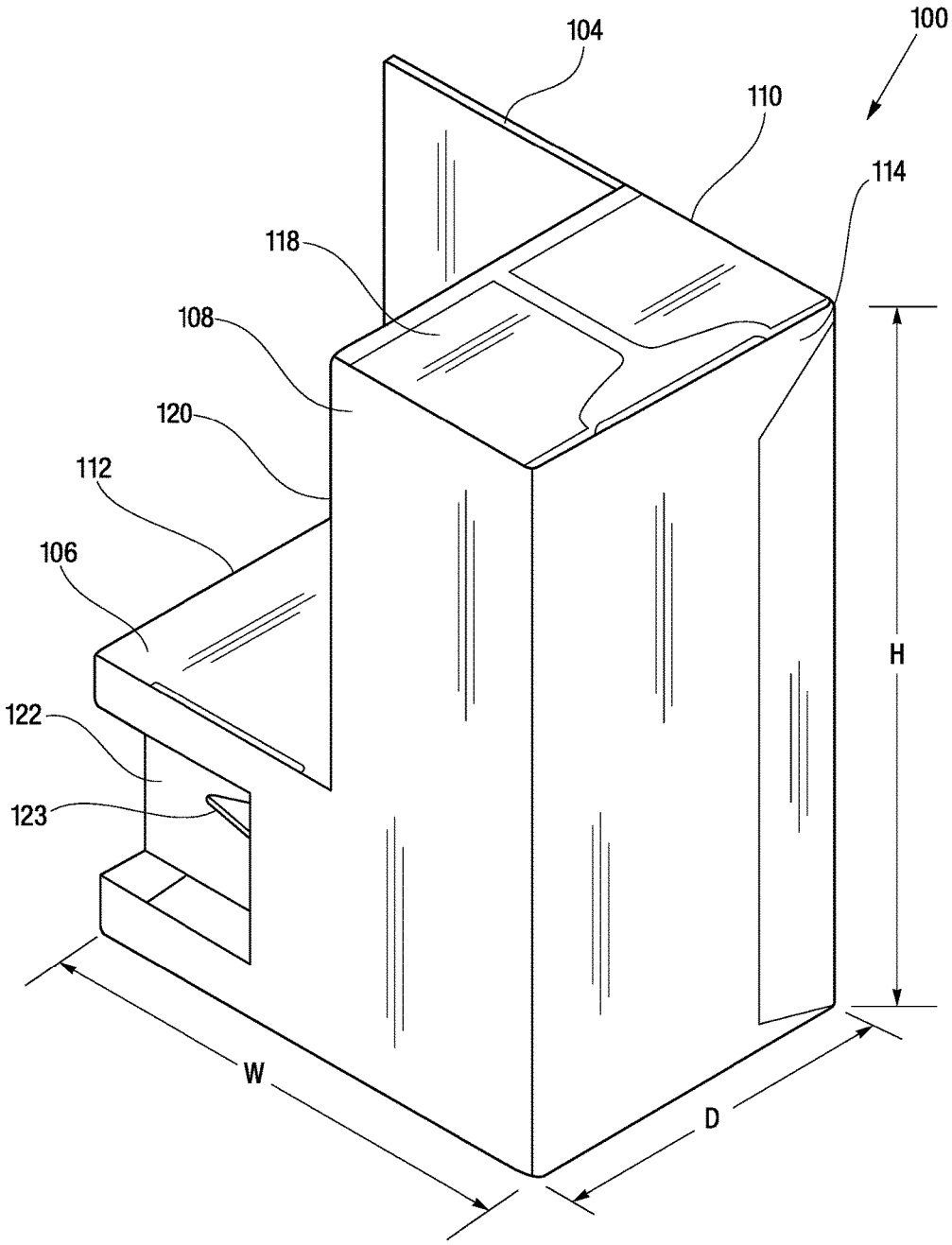
FIG. 2 is a front side perspective view of the package outer structure of the package of FIG. 1.
Figure 3:
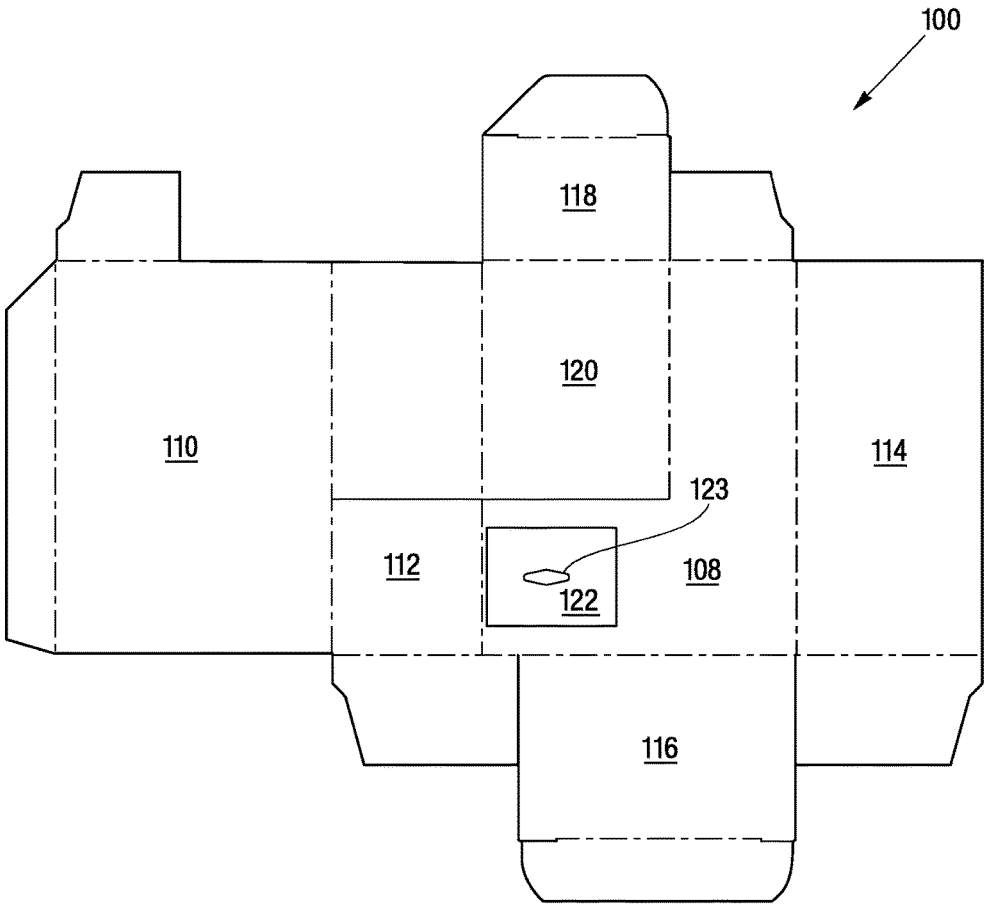
FIG. 3 is a top down view of the package outer structure of the package of FIG. 1, in unassembled form, in accordance with one embodiment of the invention.
Figure 4:
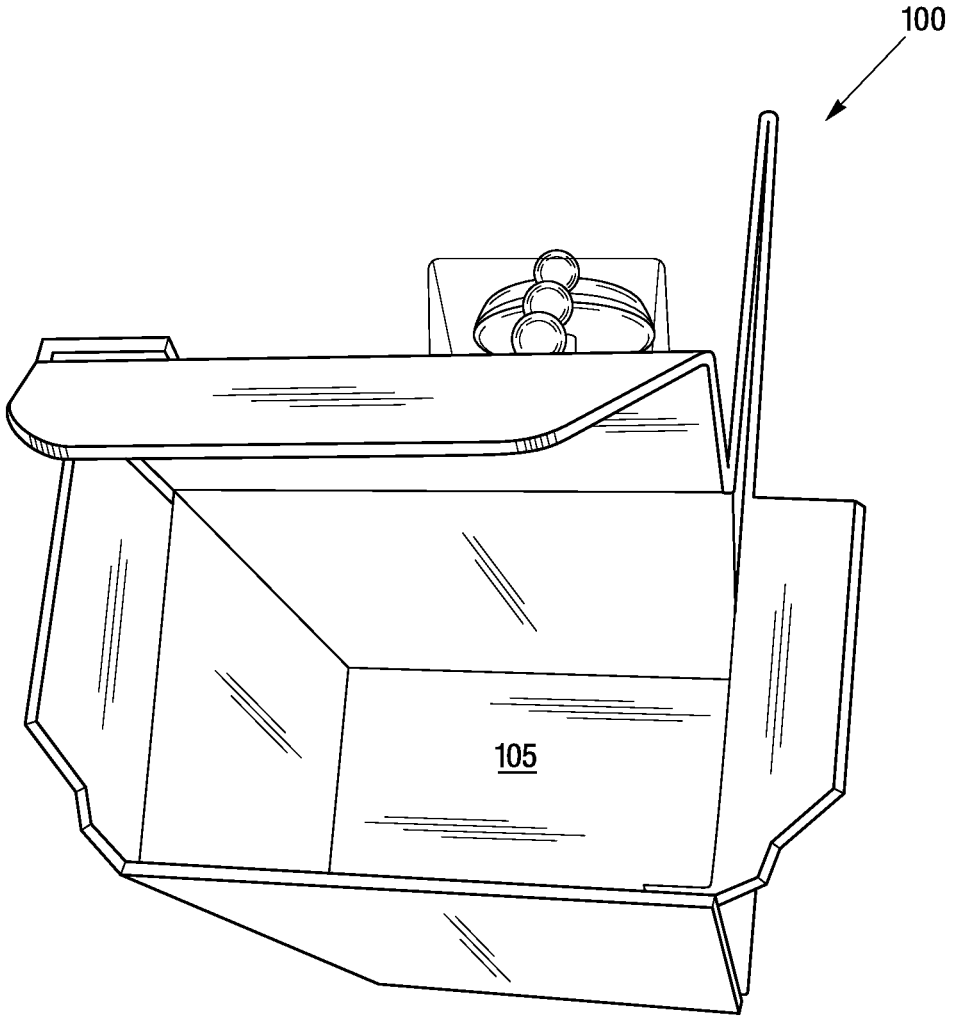
FIG. 4 is a top down view of the package of FIG. 1 showing the inner cavity.

Referring to FIG. 1, FIG. 2 and FIG. 3, a package 100 for a bath product 102 (such as a single/double shower hook) is shown in accordance with one embodiment of the present invention and includes a package outer structure 104 and a package inner structure 106. The package outer structure 104 defines an inner cavity 105 (See FIG. 4) for containing the bath product 102 (and/or components of the bath product) and includes a package front 108, a package rear 110, a package first side 112, a package second side 114, a package bottom 116 and a package top 118. Furthermore, the package outer structure 104 includes a first display window 120 for displaying a first view of the product 102 and a second display window 122 having a product opening 123 for supportingly interacting with the product 102 such that a second view of the product 102 can be displayed in the second display window 122. The package outer structure 104 also includes a package height H, a package width W and a package depth D, wherein the package height H is larger than the package width W and package depth D such that the package 100 is substantially rectangular in shape. It should be appreciated that in other embodiments, the package width W may be larger than the package height H and the package depth D, or the package depth D may be larger than the package height H and the package width D. Furthermore, in still yet another embodiment, the package width W package height H and package depth D may be substantially equal in size such that the package 100 is substantially square in shape.

Figure 5:
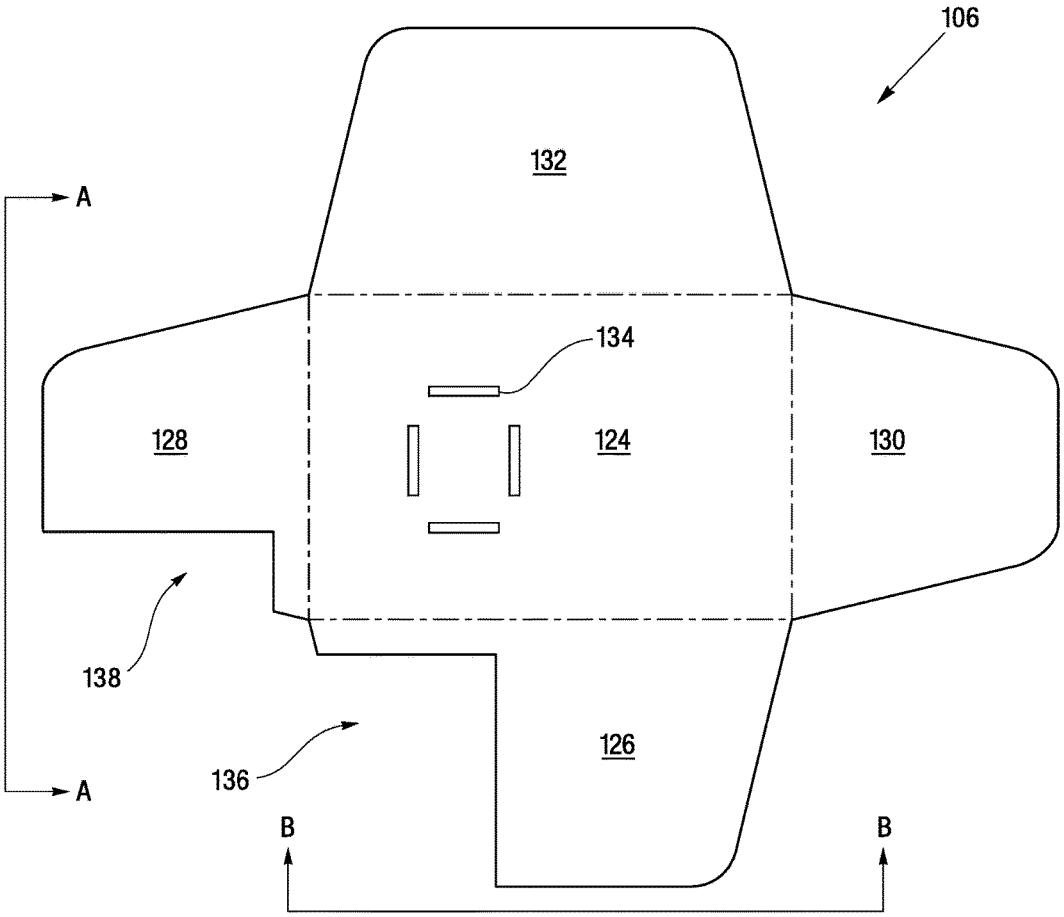
FIG. 5 is a top down view of the package inner structure of the package of FIG. 1, in unassembled form, in accordance with one embodiment of the invention.
Figure 6:
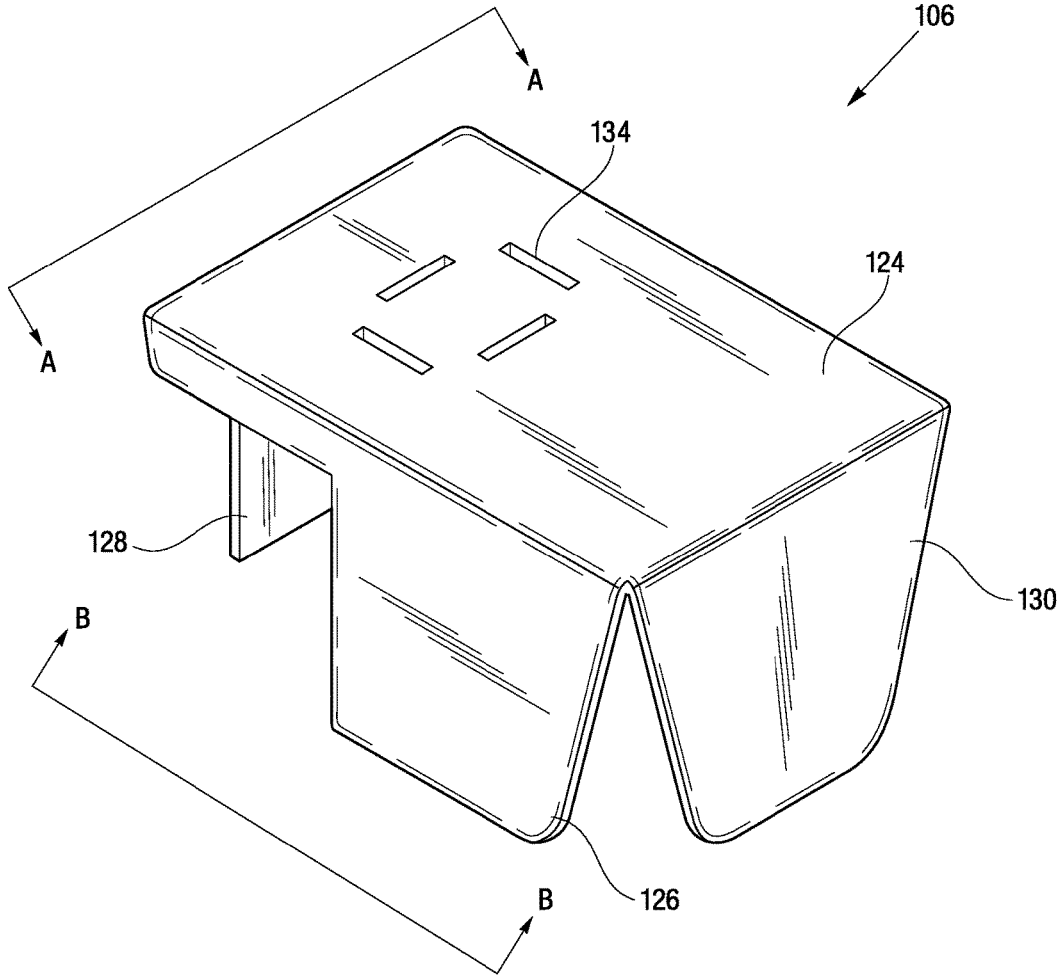
FIG. 6 is a front side perspective view of the package inner structure of the package of FIG. 1.
Figure 7:
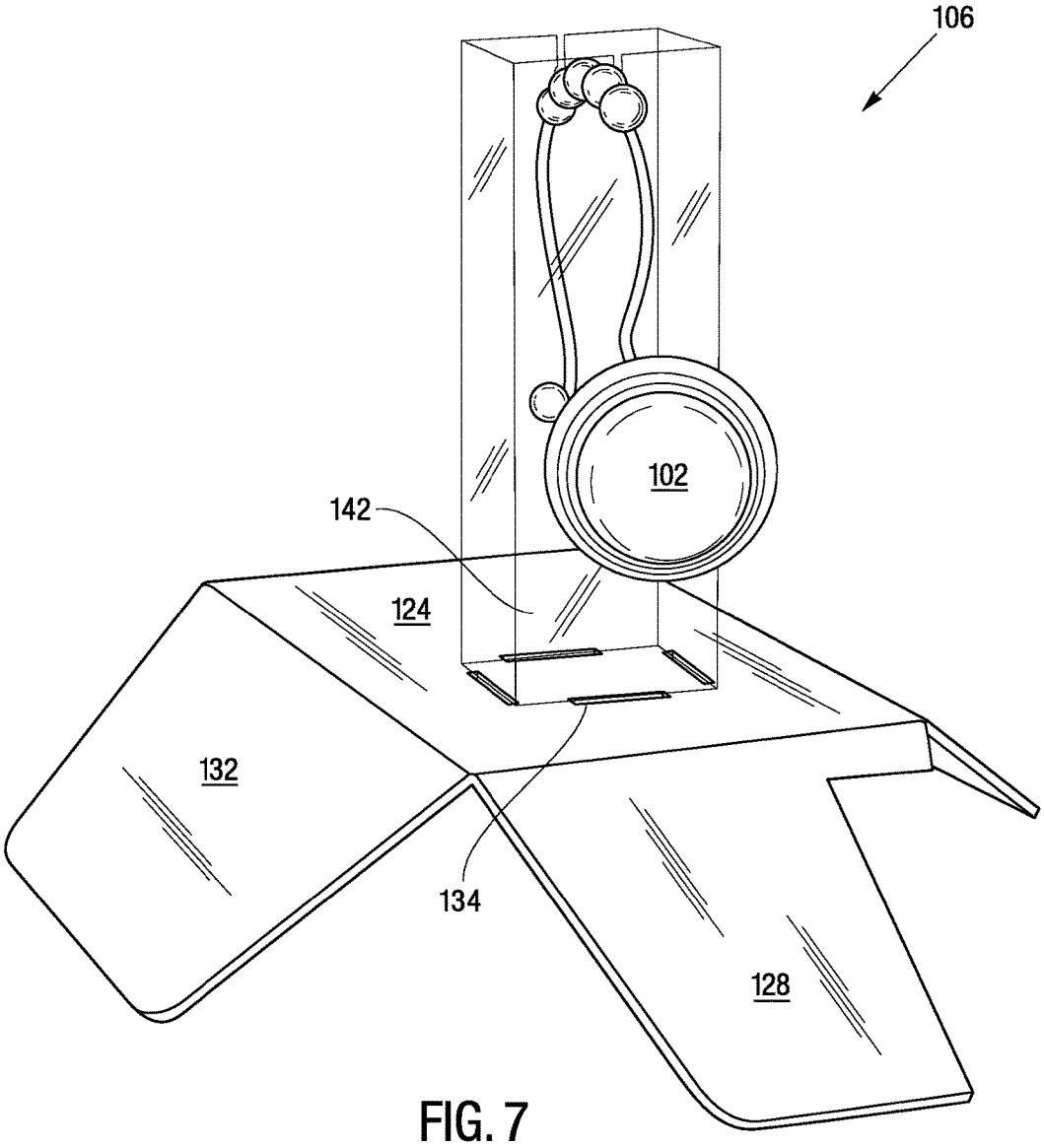
FIG. 7 is a side view of the package inner structure of the package of FIG. 1.

Referring to FIG. 5, FIG. 6 and FIG. 7, the package inner structure 106 includes a support top 124, a front support leg 126, a first side support leg 128, a second side support leg 130 and a rear support leg 132. Additionally, the package inner structure 106 includes a plurality of mounting openings 134 located in the support top 124 for mounting a product support 142 as discuss further herein. The front support leg 126 includes a front cutout portion 136 and the first side support leg 128 includes a side cutout portion 138. It should be appreciated that the package inner structure 106 is sized such that when located within the inner cavity of the package outer structure 104, the support top 124 forms the bottom of the first display window 120 and the front cutout portion 136 and side cutout portion 138 allow space so as not to cover the second display window 122 which is formed by the package outer structure 104.

Figure 8:
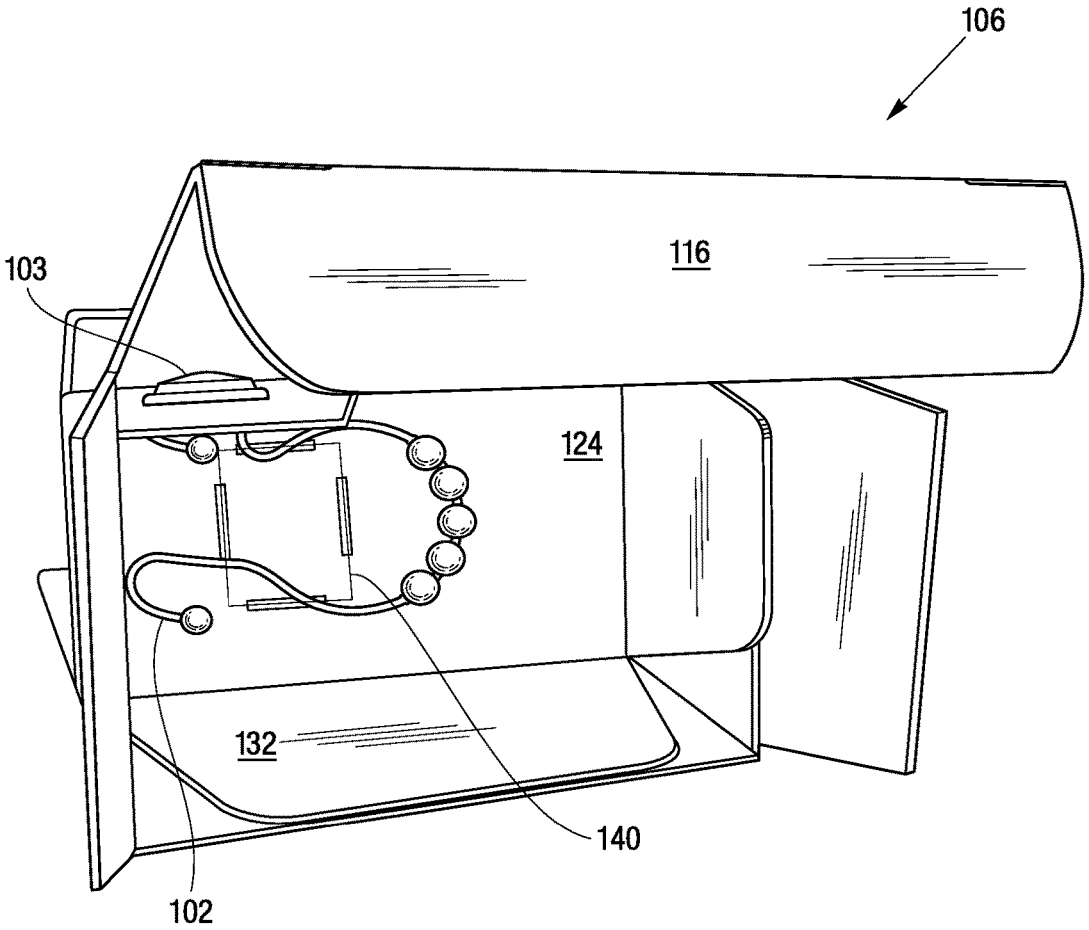
FIG. 8 is a bottom up view of the package inner structure of the package of FIG. 1, in accordance with one embodiment of the invention.

When the package 100 is assembled the package inner structure 106 is located within the inner cavity of the package outer structure 104 proximate the bottom section of the package 1100 so that the front support leg 126, first side support leg 128, second side support leg 130 and rear support leg 132 are folded downward toward the package bottom 116. As such, the bottom of the front support leg 126, first side support leg 128, second side support leg 130 and rear support leg 132 are located proximate the package bottom 116 and act as a support for the package inner structure 106. The bath product 102, such as a shower hook having a decorative button 103, may be associated with the second display window 122 such that the decorative button is protruding out of the product opening 123 to be located within the second display window 122. The metal hook portion of the shower hook 102 is located within the inner cavity underneath the package inner structure 106 to be between the support top 124 and the package bottom 116, as shown in FIG. 8.

Figure 9:
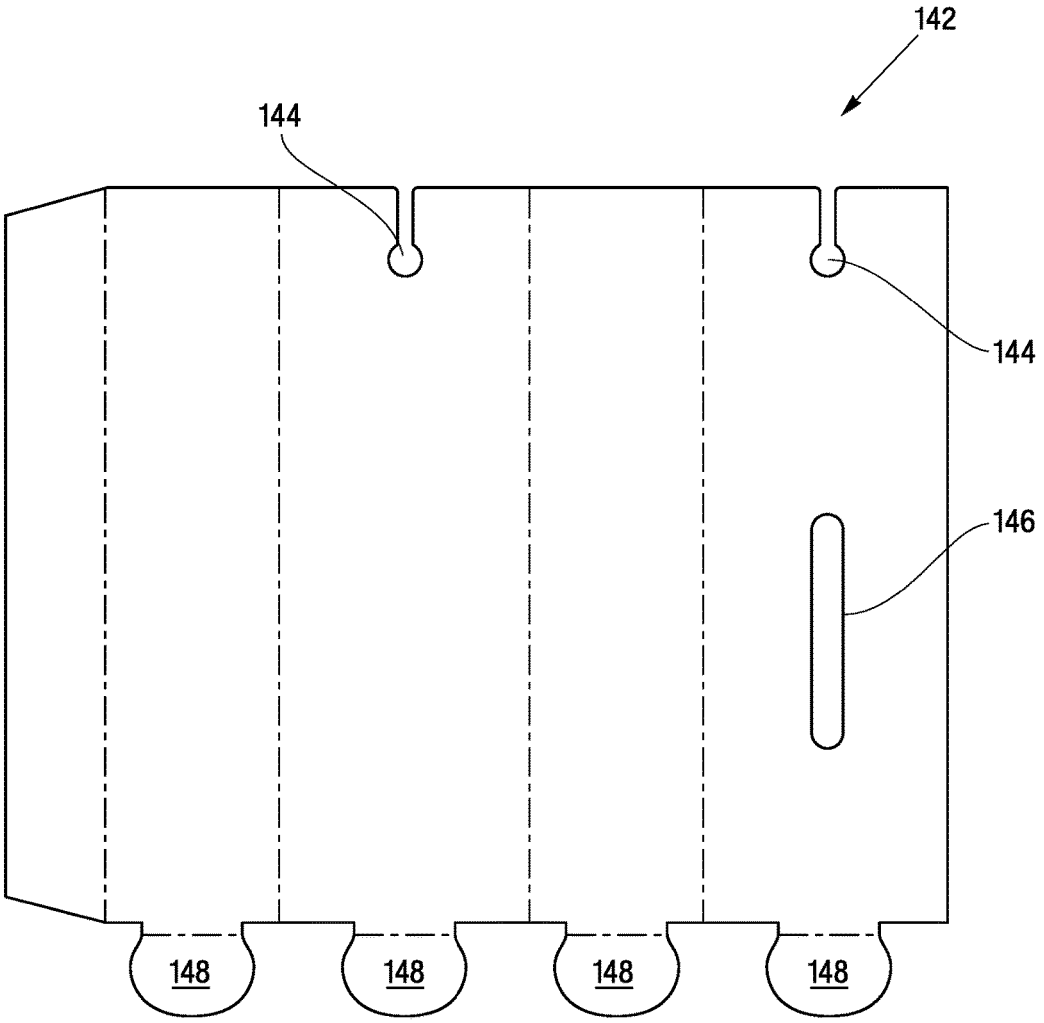
FIG. 9 is a top down view of the product support of the package of FIG. 1, in unassembled form, in accordance with one embodiment of the invention.
Figure 10A:
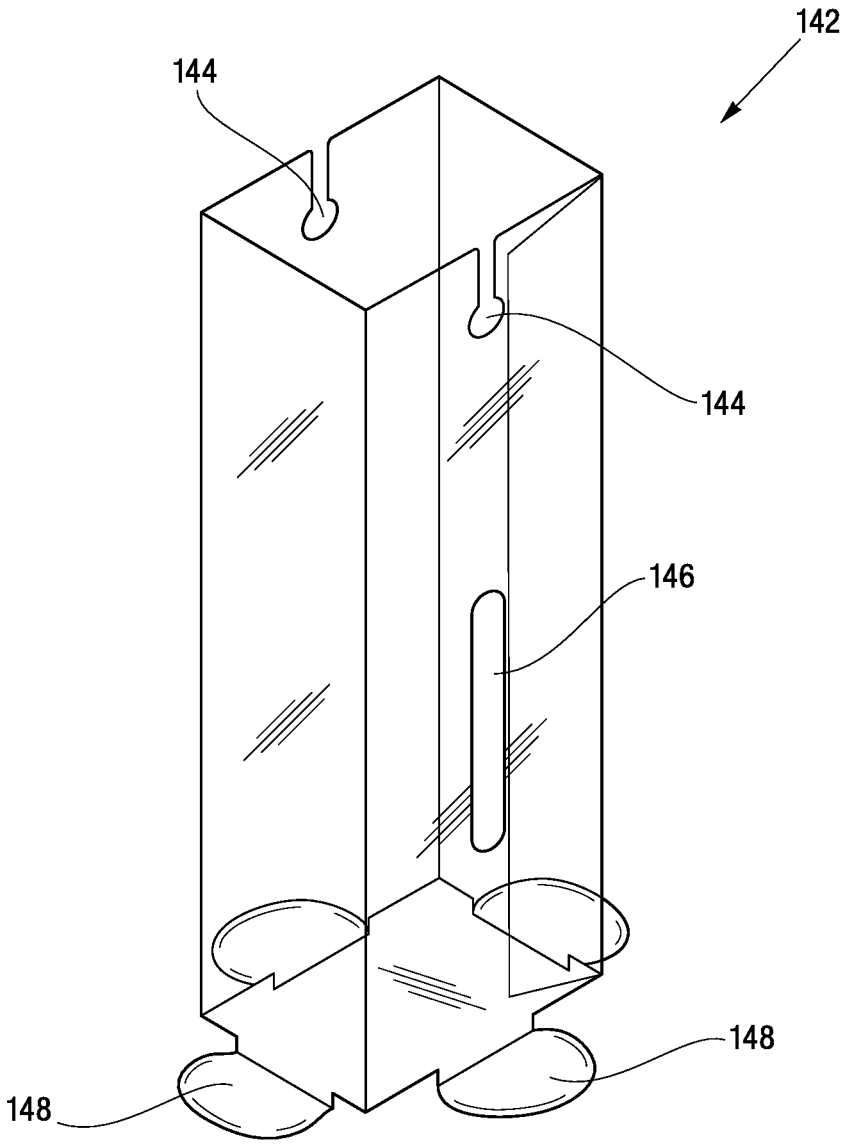
FIG. 10A is a side perspective view of the product support of the package of FIG. 1, in assembled form, in accordance with one embodiment of the invention.
Figure 10B:
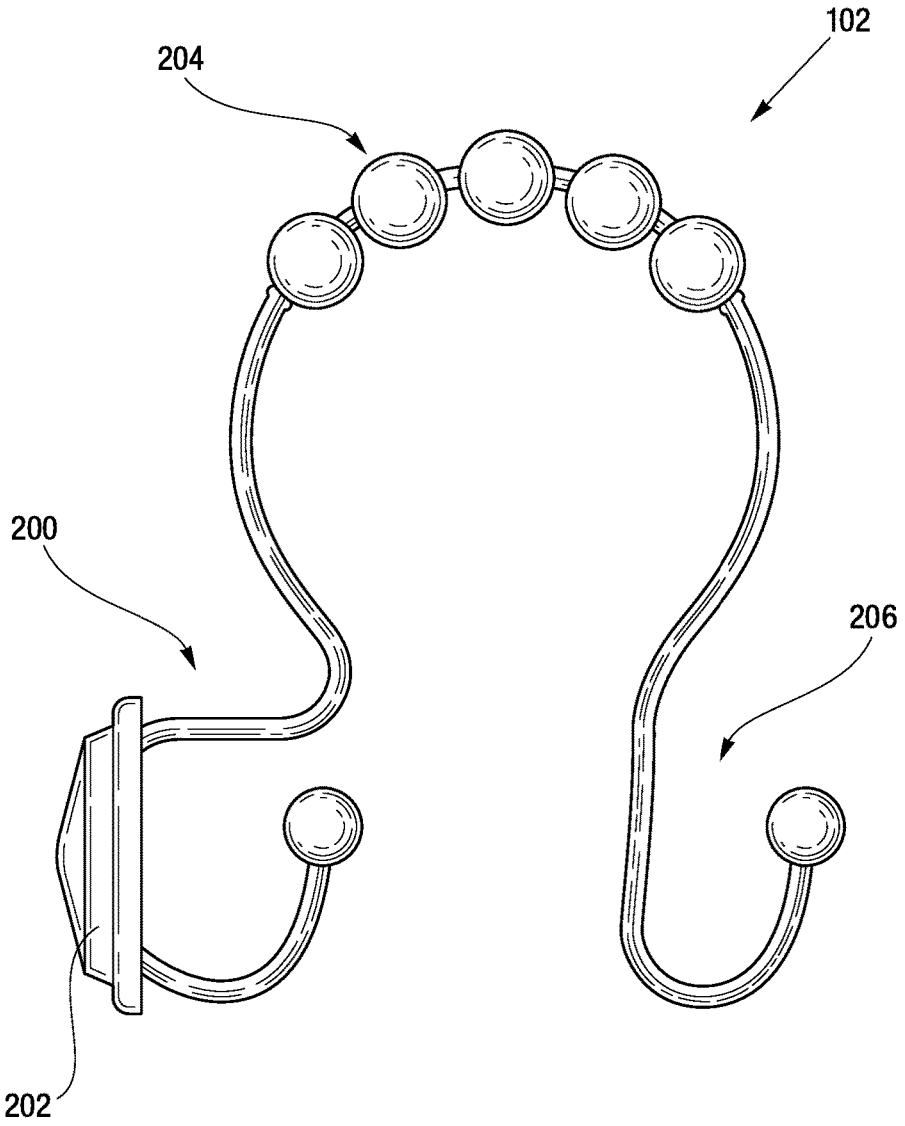
FIG. 10B is a side view of one embodiment of a shower hook product for use with the package of FIG. 1.
Figure 11:
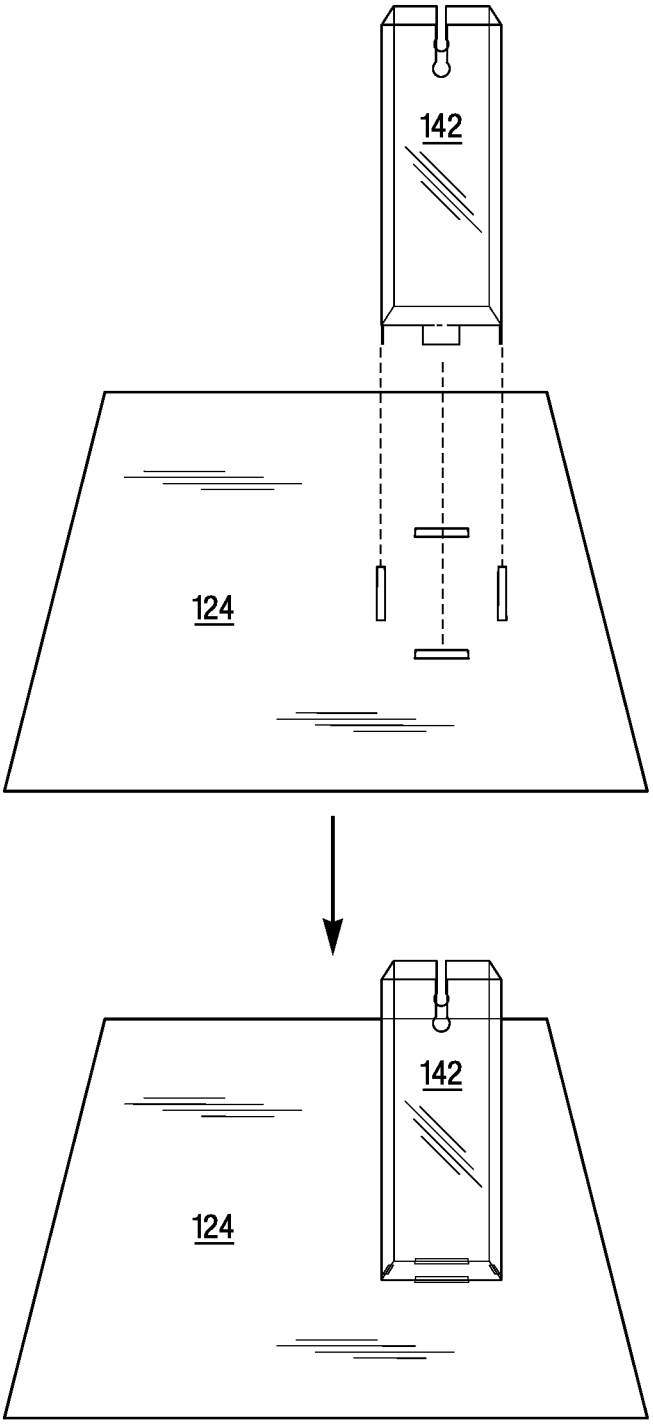
FIG. 11 is a side isometric view of the product support of the package of FIG. 1, being associated with the package inner structure of FIG. 5.

Referring to FIG. 9, FIG. 10A and FIG. 11, a product support 142 having a mounting slot 144, a sidewall slot 146 and a plurality of interface tabs 148 is provided, in accordance with one embodiment of the invention. When folded (See FIG. 10) the product support 142 is substantially rectangular in shape and held together by inserting the plurality of interface tabs 148 into the plurality of mounting openings 134 such that the tabs protrude below the support top 124. In one embodiment, the interface tabs 148 and/or mounting openings 134 may be configured such that when the interface tabs 148 are located within the mounting openings 134, they are securely contained therein. Additionally, it should be appreciated that in another embodiment, the interface tabs 148 may be bent up to lay substantially flat against the bottom surface of the support top 124, where a plastic stabilizing plate 140 (See FIG. 8) is located over the interface tabs 148 and attached to the bottom surface of the support top 124 via tape, adhesive or other apparatus/method suitable to the desired end purpose. This tab/stabilizing plate combination advantageously keeps the product support 142 secure and may (although not necessarily) be used to limit the movement of the shower hook 102 when the show hook 102 is associated with the product support 142. The package bottom 116 may then be closed. It should be appreciated that when associating the product support 142 with the support top 124, the product support 142 is positioned such that the sidewall slot 146 is facing the package first side 112.

Referring again to FIG. 7, FIG. 10A and FIG. 10B, in the present embodiment the shower hook 102 includes a shower hook front 200 having a medallion 202, a shower hook top 204 and a shower hook rear 206 and is associated with the product support 142 by placing portions of the shower hook top 204 (i.e. the wire ring portion of the shower hook 102) within the mounting slots 144 such that a portion of the wire of the shower hook rear 206 is located within the sidewall slot 146, wherein the button or medallion 202 is facing toward the package first side 112. It should be appreciated that this configuration advantageously presents a side profile view of the product 102 shown in the first display window 120 and a front view of the product 102 (and the button 103) is shown in the second display window 122. Additionally, as shown the display color shown in the first display window 120 and the second display window 122 may be of a different color than the outer surface of the package outer structure 104. Furthermore, additional product 102 may be contained with the inner cavity 105 such that when the package top 118 is closed, the additional product 102 is securely contained therein.

Figure 12:
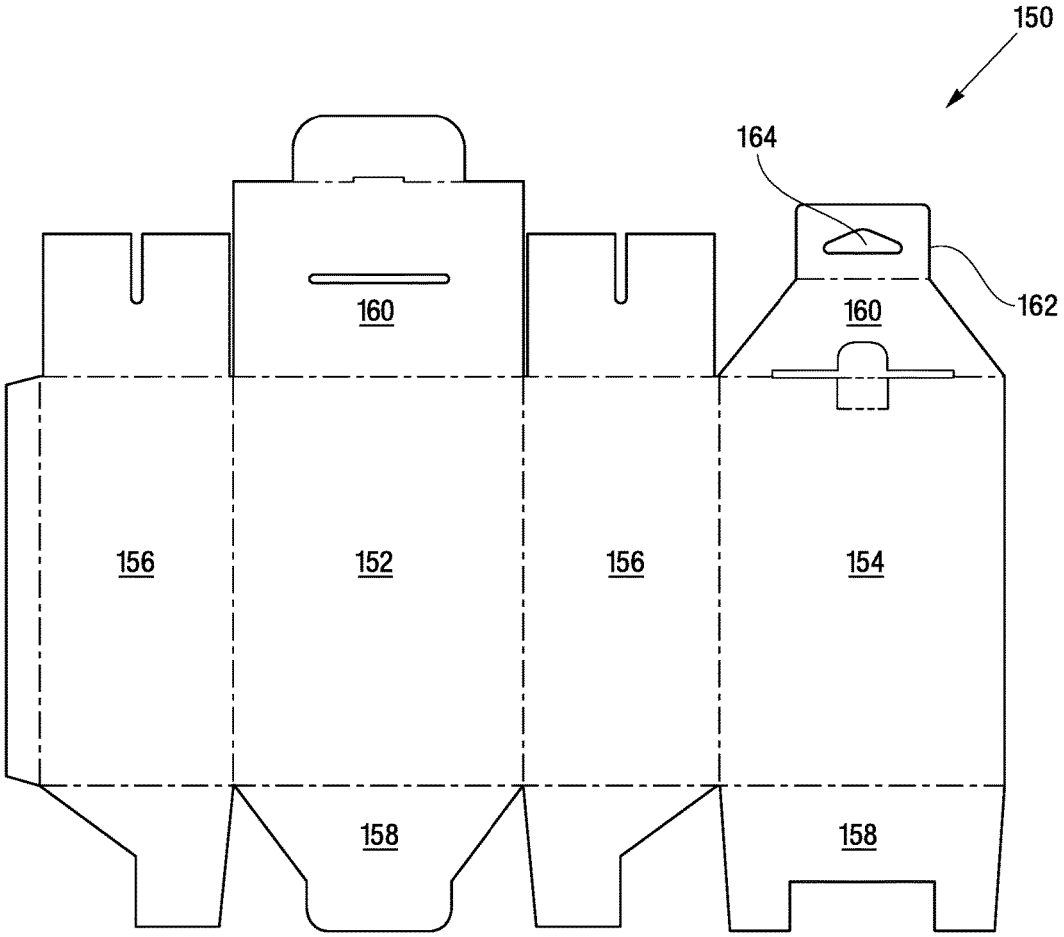
FIG. 12 is a top down view of the product outer package of the package of FIG. 1, in unassembled form, in accordance with one embodiment of the invention.
Figure 13:
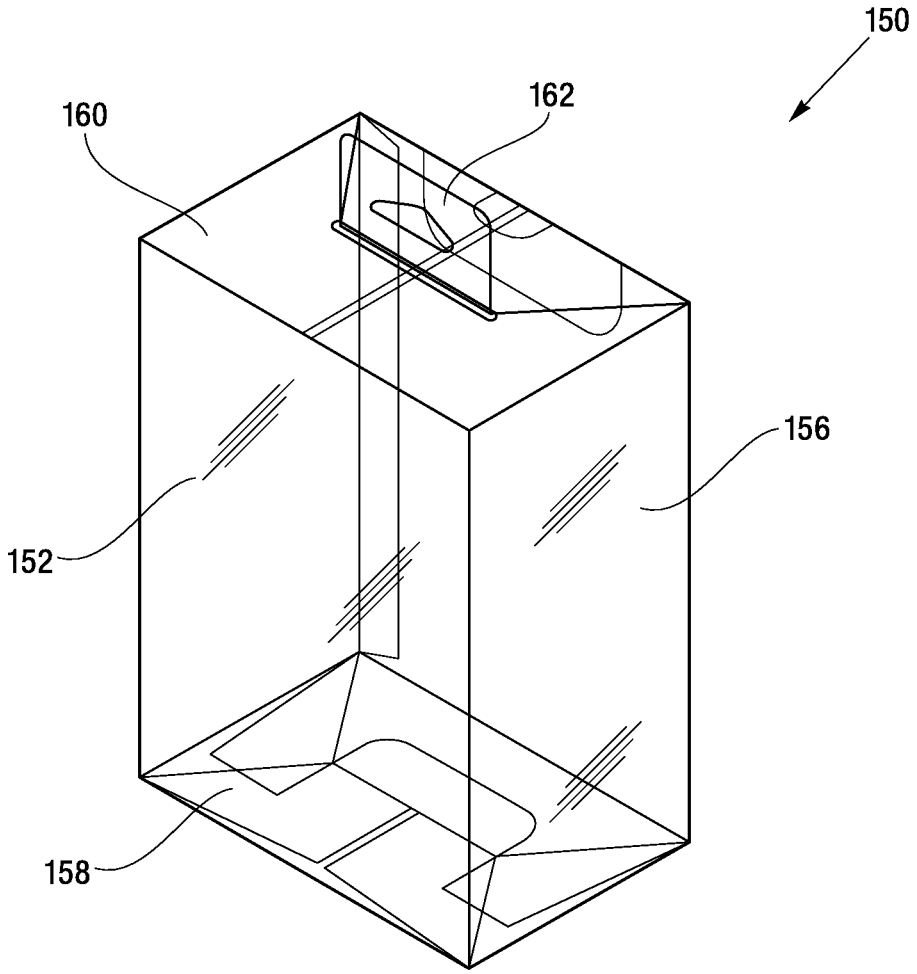
FIG. 13 is a front side perspective view of the product outer package of the package of FIG. 1, in assembled form.
Figure 14:
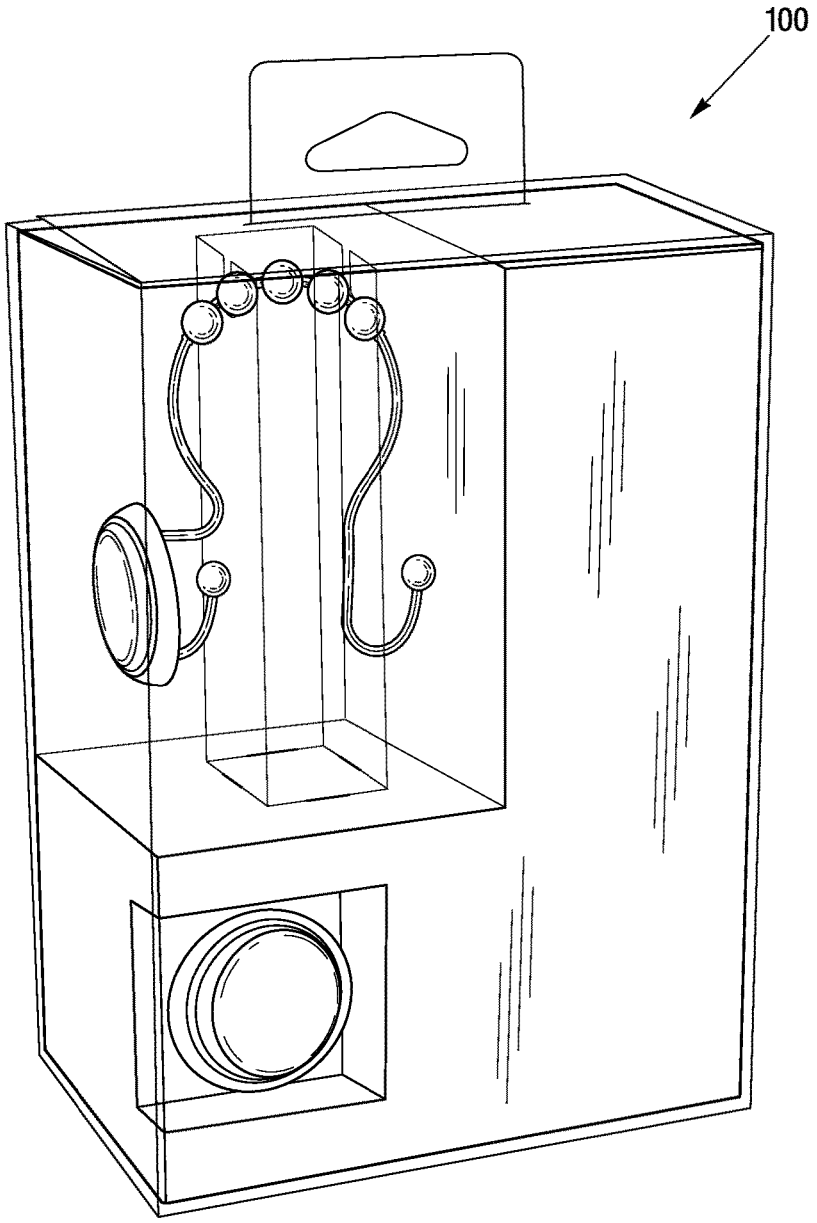
FIG. 14 is a front side perspective view of the package of FIG. 1 containing a bath product, in accordance with one embodiment of the invention.

Referring to FIG. 12 and FIG. 13, the package 100 may further include a product outer package 150, where the product outer package 150 is substantially translucent so that the display windows 120, 122 as well as color, markings, artwork and product information on the outer surface of the package outer structure 104 can be seen. The product outer package 150 may include an outer package front wall 152, an outer package rear wall 154, outer package side walls 156, an outer package bottom 158 and an outer package top 160, where the outer package top 160 may include a hanger tab 162 having a hanger opening 164 for receiving and resting on a display hanger. The product outer package 150 is configured to be folded together to define a product outer package cavity 166 for containing the package outer structure 104. When the package outer structure 104, package inner structure 106 and shower hook are assembled together as described herein, the combination is located within the assembled product outer package 150, as shown in FIG. 14.

Figure 15:
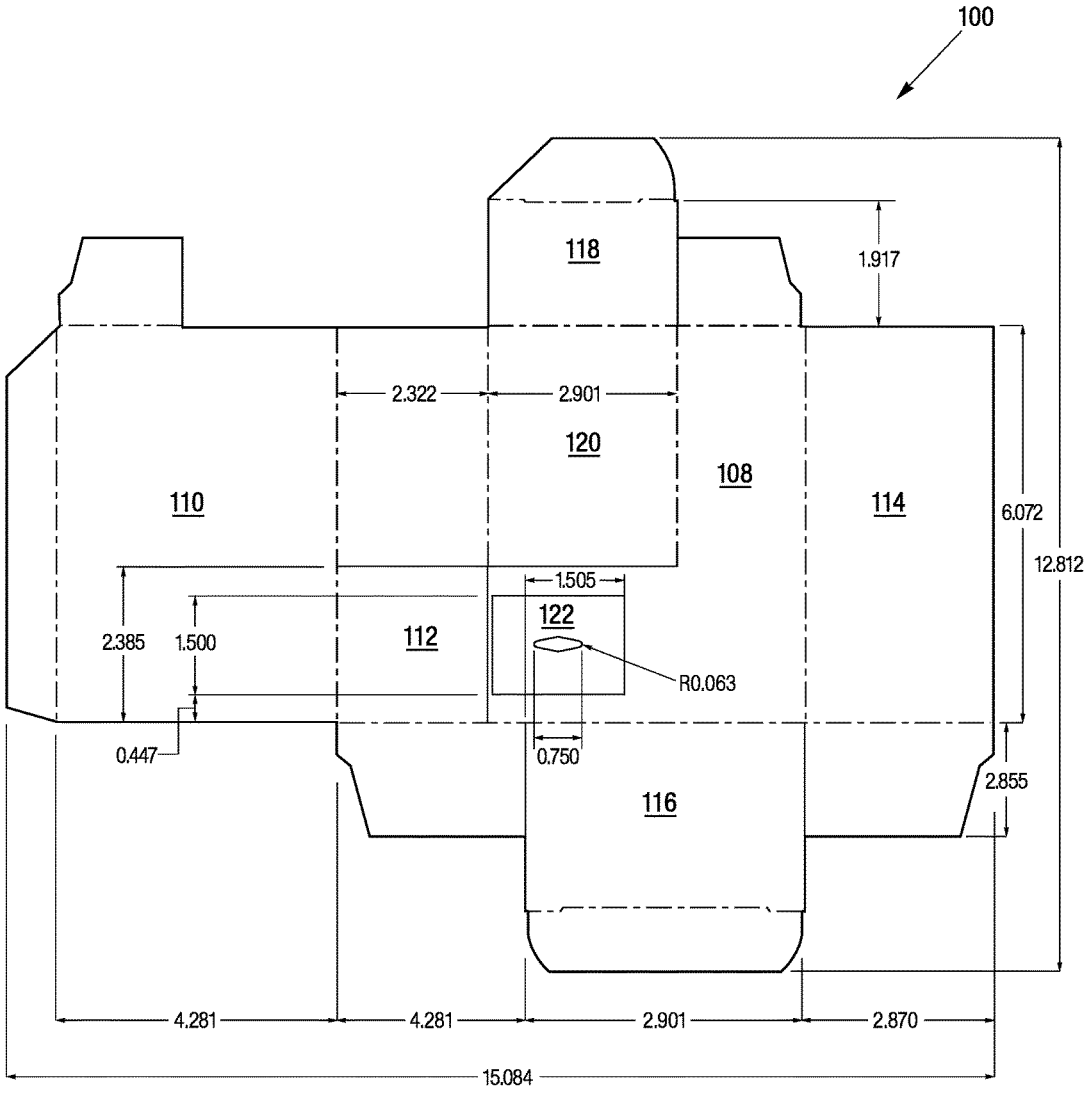
FIG. 15 is a top down view of the package outer structure of the package of FIG. 1, in unassembled form, showing dimensions in accordance with one embodiment of the invention.
Figure 16:
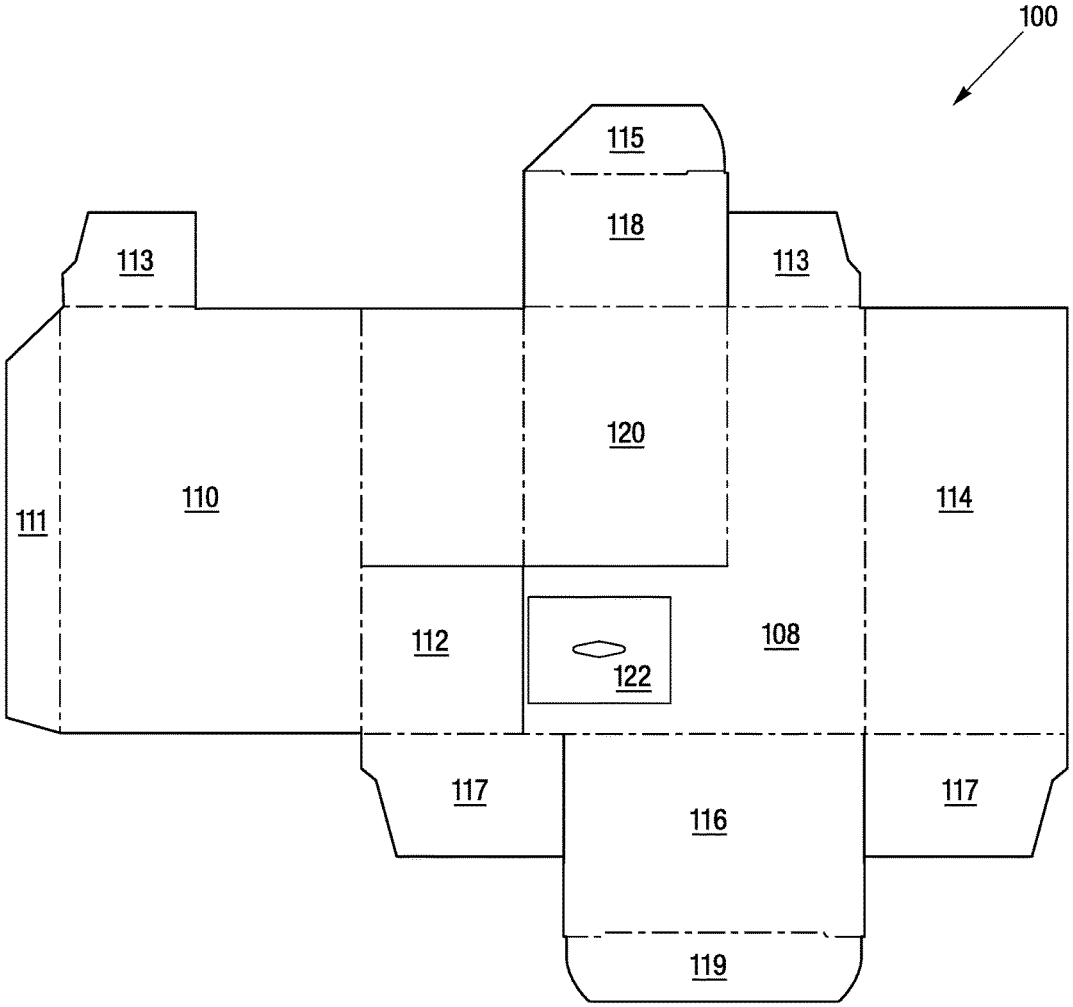
FIG. 16 is a top down view of the package outer structure of the package of FIG. 1, in unassembled form, in accordance with one embodiment of the invention.
Figure 17:
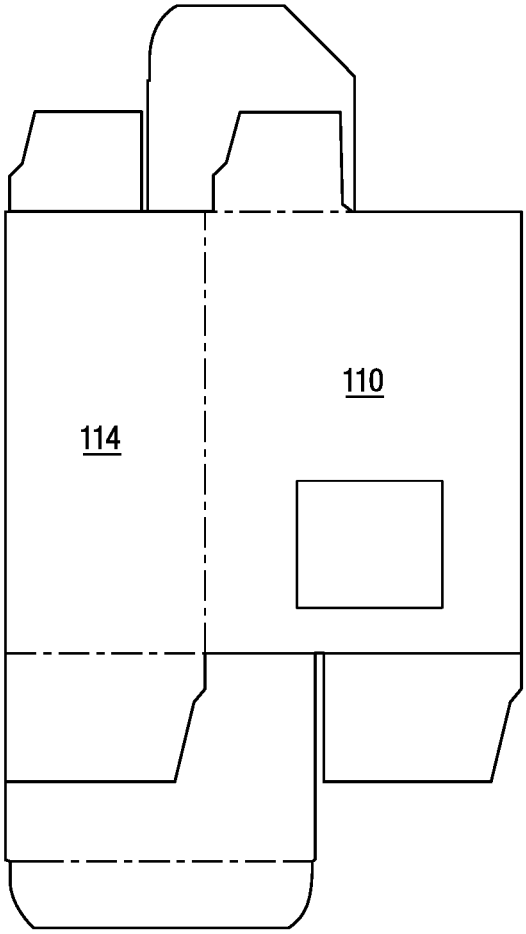
FIG. 17 is a rear view of the package outer structure of the package of FIG. 1, in partially assembled form, in accordance with one embodiment of the invention.
Figure 18:
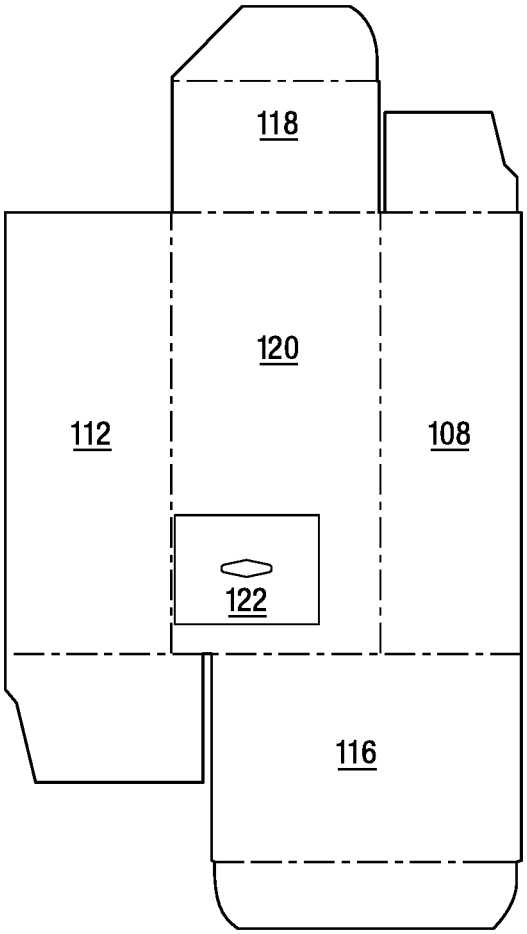
FIG. 18 is a front view of the package outer structure of the package of FIG. 1, in partially assembled form, in accordance with one embodiment of the invention.
Figure 19:
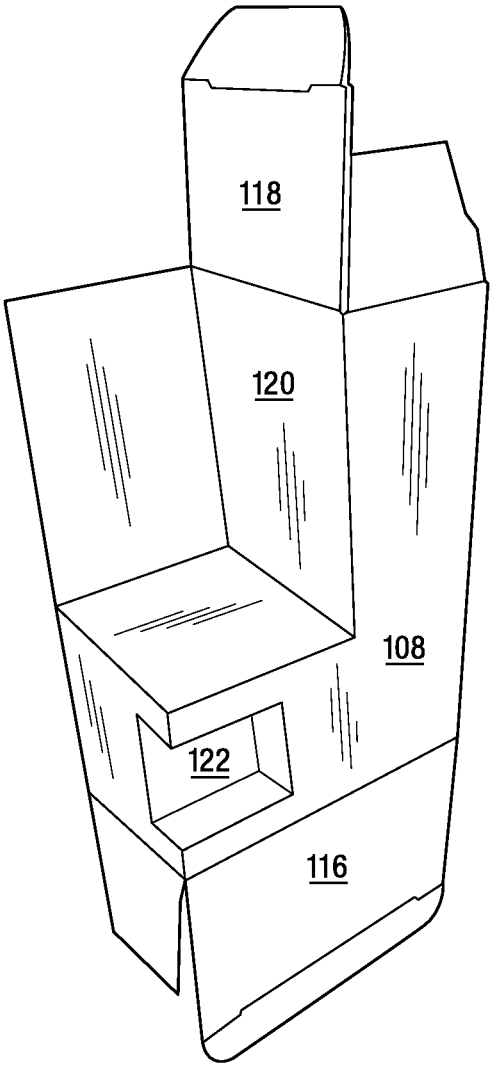
FIG. 19 is a front side isometric view of the package outer structure of the package of FIG. 1, in partially assembled form, in accordance with one embodiment of the invention.

Referring to FIG. 15, one embodiment of the package outer structure 104 is shown, where the package height H is about 6.072 inches, the package width W is about 4.281 inches and the package depth D is about 2.901 inches. Moreover, when viewed from the side of the package outer structure 104, the first display window 120 is preferably about 60% of the size of the side of the package outer structure 104, but may range from between about 50% to about 75% of the side of the package outer structure 104. Additionally, when viewed from the side of the package outer structure 104, the second display window 122 is preferably about 62% of the height of the package first side 112 and about 20% of the width of the package first side 112. However, when viewed from the side of the package outer structure 104, the size of the second display window 122 may range from between about 50% to about 75% of the height of the package first side 112 and from about 10% to about 30% of the width of the package first side 112.

Furthermore, when viewed from the front of the package outer structure 104, the first display window 120 is preferably about 55% of the width of the front of the package outer structure 104 and about 55% of the height of the front of the package outer structure 104. However, when viewed from the front of the package outer structure 104, the first display window 120 may range from between about 45% to about 65% of the front of the package outer structure 104.

Additionally, when viewed from the front of the package outer structure 104, the second display window 122 is preferably about 25% of the height of the package first side 112 and about 35% of the width of the package first side 112. However, when viewed from the front of the package outer structure 104, the size of the second display window 122 may range from between about 15% to about 35% of the height of the package first side 112 and from about 25% to about 45% of the width of the package first side 112.

It should be appreciated that the size and shape of the first display window 120 and/or the second display window 122 may vary dependent on the size and shape of the product being displayed. Thus, additional embodiments contemplate other shapes and relational sizes for the first display window 120 and/or the second display window 122. For example, in another embodiment, the first display window 120 and the second display window 122 may have relatively the same size but may be round in shape, or in still yet another embodiment the first display window 120 may be smaller than the second display window 122.

Referring to FIG. 16, FIG. 17, FIG. 18 and FIG. 19, the package 100 may be assembled by folding the package 100 such that the flap 111 of package rear 110 is adjacent to the inside surface of package second side 114. The flap 111 is then securely attached to the package second side 114 via adhesive. It is contemplated that other attaching methods may be used as desired suitable to the desired end purpose, such as a flap/slot arrangement where the slot receives the flap, or via staples. This configuration forms the inner cavity 105 of the package outer structure 104 where the top and bottom of the package outer structure 104 are uncovered. The product 102 is secured to the inner structure 106 as previously discussed and the inner structure 106 and product combination 102 is inserted into the inner cavity 105 of the package outer structure 104 such that the front of the product 102 (i.e. medallion 103) is shown in the first display window 120 oriented to face the side of the package outer structure 104. Accordingly, the side of the product 102 is shown in the first display window 120 and oriented to face the front of the package outer structure 104. Furthermore, when the product 102 and inner structure 106 is located within the inner cavity 105 as described above, the medallion 103 of a product is shown in the second display window 122 such that the front of the medallion 103 is facing the front of the second display window 122 and the side of the medallion 103 is facing the side of the second display window 122.

When the product 102 and inner structure 106 are located within the inner cavity 105, the bottom flaps 117 are folded inwardly to at least partially cover the opening in the bottom of the package outer structure 104. The package bottom 116 is then folded to cover the bottom flaps 117 and the package bottom flap 119 is folded and tucked into the inner cavity 105. It should be appreciated that the configuration and/or shape of the bottom flaps 117 and the package bottom flap 119 operate such that they interact with each other to secure the package bottom 116 in place. This closes the bottom of the package outer structure 104. As the top of the package outer structure 104 is open, additional product 102 and/or literature may be located within the inner cavity 105 via the opening at the top of the package outer structure 104.

When the package outer structure 104 is ready to be closed, the top flaps 113 are folded inwardly to at least partially cover the opening in the top of the package outer structure 104. The package top 118 is then folded to cover the top flaps 113 and the package top flap 115 is folded and tucked into the inner cavity 105. It should be appreciated that the configuration and/or shape of the top flaps 113 and the package top flap 115 operate such that they interact with each other to secure the package top 118 in place.

Figure 20:
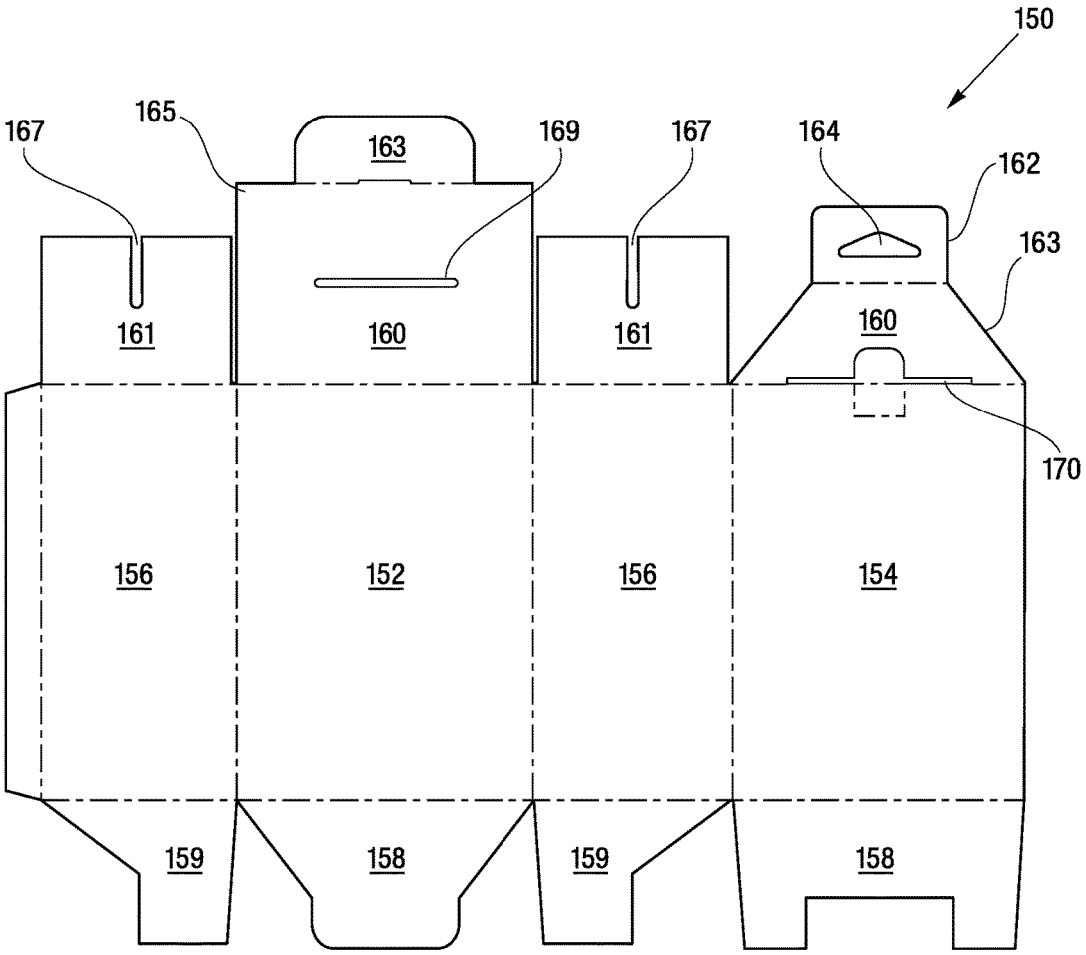
FIG. 20 is a top down view of the product outer package of the package of FIG. 1, in unassembled form, in accordance with one embodiment of the invention.

Referring to FIG. 20 and again to FIG. 13 and FIG. 14, the assembled package outer structure 104 containing the product 102 is then located within the product outer package cavity 166 and the outer package bottom 158, which includes bottom flaps 159, is folded to securely stay closed. It should be appreciated that the outer package bottom 158 and bottom flaps 159 are configured such that when folded together they interact to securely enclose the bottom of the outer package 150. Additionally, it is contemplated that in other embodiments the outer package 150 may have an enclosed bottom. The top of the outer package 150 is closed by folding the first portion 163 of the outer package top 160 to cover the top opening such that the hanger tab 162 is facing upward and folding the top flaps 161 such that the hanger tab 162 is contained within first hanger slots 167. The second portion 165 of the outer package top 160 is folded such that the hanger tab 162 is protruding from the hanger tab slot 169 and the second portion tab 163 is securely located within the first portion tab slot 170. It should be appreciated that the configuration and/or shape of the second portion tab 163 and the first portion tab slot 170 operate such that they interact with each other to secure the outer package top 160 in place.

It should be appreciated that the product outer package 150 and/or the product support 142 may be constructed from any material that is bendable and/or that is suitable to the desired end purpose, such as a plastic material. Moreover, it should be appreciated that the package outer structure 104 and/or package inner structure 106 may be constructed from any material that is rigid and bendable and that is suitable to the desired end purpose, such as a plastic material, a cardboard material, a composite material or a combination thereof.

It should be appreciated that in an additional embodiment, a package inner structure 106 may not be used and the support top 124 may be integrated with the package outer structure 104. In this case, the support top 124 having a plurality of mounting openings 134 may be part of the package outer structure 104. Accordingly, when the package outer structure 104 is assembled, the support top 124 is folded into place. As the support top 124 is part of the package outer structure 104, support legs may not be necessary to support the weight of a product on the support top 124 (although support legs may be used if desired). Moreover, it is contemplated that the product outer package 104 may include only one display window (such as the first display window 120). Additionally, while the product packaging is discussed herein with relation to the sale of multiple products (for example, more than one shower hook), it is contemplated that the product packaging may be used with only one product (for example, only one shower hook). Moreover, while the product packaging is discussed herein with relation to the bath products, it is contemplated that the product packaging may be used with any type of product, such as non-bath products.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

We claim:

1. A product package for displaying a bath product, comprising:

a package outer structure;

a package inner structure including a support top having at least one mounting opening, wherein the package outer structure defines an inner cavity for containing the package inner structure and a plurality of bath products and wherein the package outer structure includes a first cutout portion which defines a first display window and a second cutout portion which defines a second display window, wherein the second cutout portion is located below the first cutout portion and wherein the first and second display windows are viewable from the front and at least one side of the product package, and a product support having at least one interface tab, wherein the at least one interface tab is configured to securingly interact with the at least one mounting opening, such that when the at least one interface tab interacts with the at least one mounting opening, the product support is configured to be located within the first display window, and wherein the package inner structure is configured to be contained within a portion of the inner cavity such that when contained within the inner cavity, the package inner structure is configured to support a first bath product of the plurality of bath products such that at least a portion of the first bath product is displayed in the first display window, wherein when the package inner structure is located within the inner cavity, the support top is configured to be located adjacent the first display window, and the package outer structure is configured to support a second bath product of the plurality of bath products such that at least a portion of the second bath product is displayed in the second display window.

2. The product package of claim 1, further comprising a bath product, wherein the bath product includes a shower hook.

3. The product package of claim 1, further comprising a translucent outer package including a hanger tab having a hanger opening configured for engaging with a product hanger.

4. The product package of claim 1, wherein the product support is configured to securely retain a first product of the plurality of bath products such that the first product is located within the first display window.

5. The product package of claim 1, further including a product support, wherein the product support is at least partially transparent.

6. The product package of claim 1, wherein the second cutout portion of the package outer structure includes a product opening configured to contain the second bath product of the plurality of bath products such that the second bath product is within the second display window.

7. The product package of claim 1, wherein the package outer structure includes a top opening communicated with the inner cavity and wherein the inner cavity is configured to contain at least one of the plurality of bath products.

8. A product package for displaying a product, comprising:

a package outer structure which defines an inner cavity for containing a plurality of products, wherein the package outer structure includes a first cutout portion that defines a first display window and a second cutout portion that defines a second display window, wherein the second display window is located below the first display window and wherein the first display window and second display window are viewable from the front and at least one side of the product package, and a product support having at least one interface tab, wherein the product package includes a support surface having at least one mounting opening configured to support a first product of the plurality of products such that the first product is located within the first display window, wherein the at least one interface tab is configured to securingly interact with the at least one mounting opening, such that when the at least one interface tab is located within the at least one mounting opening, the product support is configured to be located within the first display window, and wherein the package outer structure is configured to support a second product of the plurality of products such that the second product is located within the second display window.

9. The product package of claim 8, wherein the support surface is at least one of, an integral part of the package outer structure; and a support top of a package inner structure that is configured to be located within the inner cavity.

10. The product package of claim 8, further comprising a translucent outer package including a hanger tab having a hanger opening configured for engaging with a product hanger.

11. The product package of claim 9, wherein when the package inner structure is located within the inner cavity, the support top is configured to be located adjacent the first display window.

12. The product package of claim 11, wherein the product support is configured to securely retain a first product of the plurality of bath products such that the first product is located within the first display window.

13. The product package of claim 11, further including a product support, wherein the product support is at least partially transparent.

14. The product package of claim 8, wherein the second cutout portion of the package outer structure includes a product opening to contain a second product of the plurality of products such that the second product is located within the second display window.

15. The product package of claim 8, wherein the package outer structure includes a top opening communicated with the inner cavity, wherein the inner cavity is configured to contain at least one of the plurality of products.

* * * * *